United States Patent [19]

Smith et al.

[11] Patent Number: 4,938,709

[45] Date of Patent: Jul. 3, 1990

[54] CONNECTION TERMINALS FOR RIGID-WIRE LOOP CARTRIDGE LIGHT BULBS

[75] Inventors: Robert J. Smith, Farmington Hills; David J. Gardner, Fraser, both of Mich.

[73] Assignee: Judco Manufacturing Corporation, Harbor City, Calif.

[21] Appl. No.: 367,893

[22] Filed: Jun. 19, 1989

[51] Int. Cl.[5] ..... H01R 33/02

[52] U.S. Cl. ..... 439/239; 439/612; 439/698

[58] Field of Search ..... 439/226, 239, 444, 612, 439/698, 830, 835, 816; 248/221.3; 362/217; 313/315, 318, 331

[56] References Cited

U.S. PATENT DOCUMENTS 3,633,149 1/1972 Maltais ..... 439/612
4,061,940 12/1977 Fitzerald et al. ..... 439/226 X
4,288,846 9/1981 Fletcher et al. ..... 362/217
4,429,945 2/1984 Nestor ..... 439/830
4,699,445 10/1987 Porta et al. ..... 439/830 X

*Primary Examiner*—Neil Abrams
*Assistant Examiner*—Khiem Nguyen
*Attorney, Agent, or Firm*—Kras & Young

[57] ABSTRACT

Terminals for electrically contacting wire loops disposed on each end of a cartridge type bulb are formed from resilient electrically conducting sheet metal. Each terminal consists of an elongated member having a relatively narrow contact portion joined to a wider base portion at a shoulder. The contact portion has a outwardly projection tab acting to retain the wire loop of a cartridge type bulb, while the base portion has a downwardly projecting tab for securing the terminal in a lamp housing or socket assembly. A means for electrically connecting a wire to end of the base of the terminal is provided by arcuate shaped projecting tabs which can be crimped over the wire core and insulating jacket.

8 Claims, 1 Drawing Sheet

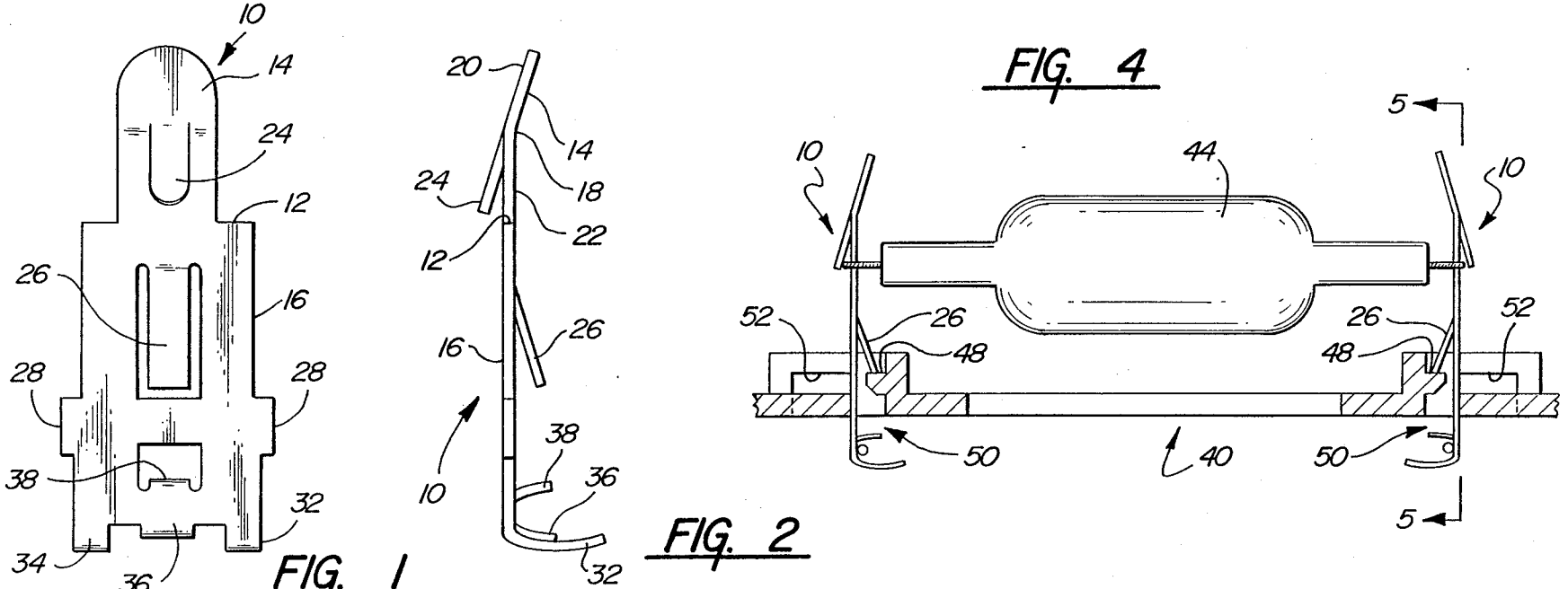
FIG. 1
FIG. 2
FIG. 4
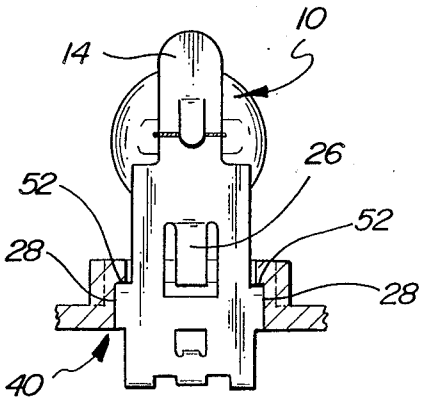
FIG. 5
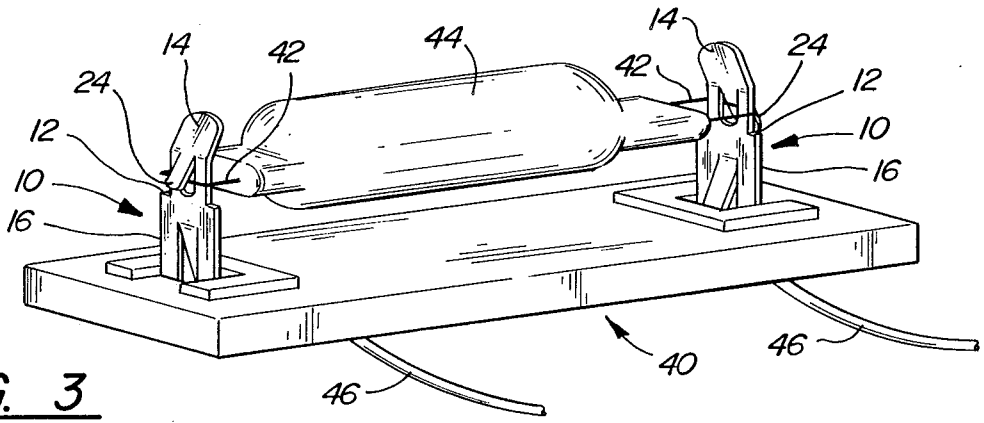
FIG. 3

CONNECTION TERMINALS FOR RIGID-WIRE LOOP CARTRIDGE LIGHT BULBS

BACKGROUND OF THE INVENTION

1. Field of the Invention

This invention generally relates to electrical connection terminals and, more particularly, to connection terminals for baseless cartridge type light bulbs having rigid-wire loop contacts extending from the bulb ends.

2. Description of the Related Art

Baseless cartridge type bulbs are standard items typically used in automotive applications such as overhead and interior lamps. Cartridge bulbs are formed from cylindrically shaped glass envelopes which contain longitudinal filaments. During manufacture, each cylinder end is pinched over a small rigid-wire loop forming an external contact for one end of the internal filament.

Conventional terminals for cartridge type bulbs are generally formed of resilient conducting material and typically hold the bulb wire loops either in tension or compression to maintain electrical contact. Because the supporting structure for the wire loop ends of a cartridge bulb is formed of glass, the axial length of a bulb between its wire loops can have a relatively large tolerance. For example, a bulb having an approximate length of 1.7 inches, typically varies by 0.050 inches in length. Due to this relatively large tolerance on bulb length, conventional terminals generally subject cartridge bulbs to relatively large tension or compression forces in order to reduce the possibility of intermittent electrical contact. This pressure, if excessive, can damage the glass envelopes of the bulbs.

Another problem commonly associated with prior art cartridge bulb terminals concerns the difficulty in inserting or removing a bulb from the terminal pairs within the lamp housing or socket assembly (hereinafter generally termed "housing"). For ease of manufacture, it is also desirable to have a terminal design which allows for easy economical installation into the housing containing the bulb.

SUMMARY OF THE INVENTION

The present invention is directed toward providing terminals for supporting and maintaining good electrical contact with cartridge type bulbs, while enabling easy bulb insertion and removal and easy installation of the terminals into a housing and providing positive retention to prevent accidental dislodging of bulb.

In its broadest form, the present invention consists of a pair of terminals which can be inserted inside the wire loop ends of a cartridge type bulb and disposed so as to place the outer inside edge of the wire loops in tension, thus providing support for the bulb while maintaining electrical contact throughout the tolerance range of the bulb to provide uniform loading. Each terminal consists of a base portion for fixing the terminal to a housing, a contact portion forming an electrical connection with one wire loop end of the bulb, and means for securing an electrical wire to the base of the terminal.

The terminal can be formed from a substantially flat sheet of conducting metal. The contact portion is of a width slightly less than the minimum inside width across a wire loop in the direction perpendicular to the longitudinal axis of the bulb, enabling the wire loop to fit over contact portion of the terminal. The base portion is of a width slightly larger than the maximum outside dimension across the wire loop so as to form a shoulder upon which the wire loop may rest after insertion of the contact portion. The contact portion of each terminal has an outwardly projecting tab for retaining the wire loop. The base portion of each terminal, having a inwardly facing tab and a shoulder area, enables insertion of the terminal into a slotted lamp housing or socket assembly until the base shoulder abuts a downwardly depending surface, with the inwardly facing tab snapping out of slot when it reaches the opposite side of the housing. Thus, the terminal can be easily installed in a housing with the base tab retaining the terminal and preventing its removal.

Means for attaching a wire to the base portion of the terminal can take many forms such as a crimp connection, a standard plug connection or any other form providing a suitable physical and electrical connection.

It is the object of this invention to provide contact terminals for baseless cartridge type bulbs that are easy to install into a housing, allow easy insertion, positive retention to prevent accidental dislodging, easy removal of the bulbs, and insure unbroken electrical contact with the wire end loops of the bulbs.

BRIEF DESCRIPTION OF THE DRAWINGS

The invention will be more fully understood by reference to the following detailed description and accompanying drawings in which:

FIG. 1 front plan view of a cartridge bulb connector terminal representing the preferred embodiment of the present invention;

FIG. 2 is side plan view of the cartridge bulb terminal as shown in FIG. 1;

FIG. 3 is a perspective view of a housing having a pair of terminals supporting a baseless cartridge bulb;

FIG. 4 is a sectional side view of a housing illustrating the tab retaining features of the terminals; and FIG. 5 is a sectional side view of the housing of FIG. 4 along lines 5—5.

DESCRIPTION OF THE PREFERRED EMBODIMENT

Referring to FIGS. 1 and 2, the preferred embodiment of the present invention will now be described. FIG. 1 is a frontal plan view of a terminal, generally designated 10, for connecting cartridge type bulbs. FIG. 2 shows a side plan view of the same terminal 10. Shoulder 12 divides terminal 10 into two portions, the contact portion 14 being relatively narrow and the base portion 16 being relatively wider than the contact portion 14.

The contact portion 14 of terminal 10 has an upper, free, rounded edge, and is further divided into two sections at a fold 18. The first section 20 represents that part of contact portion 14 from the free end to fold 18, while the second section 22 consists of that part of contact portion 14 from fold 18 to the shoulder 12. First section 20 is bent to form an acute angle with respect to the plane through the second section 22 of contact portion 14 and points in what is defined as the forwardly direction away from terminal 10. In the preferred embodiment of the invention, the second section 22 has a tab 24 projecting out of the plane of section 22 in what is defined as the rearwardly direction away from terminal 10. In other embodiments, tab 24 may be located at other positions along contact portion 14 either above or below the fold 18.

In the preferred embodiment of the present invention, the base section 16 includes a tab 26 projecting forwardly out of the plane of the base section 16 and two base shoulders 28. At the end of base portion 16, arcuate tabs 32, 34, 36, and 38, form means for securing an insulated wire and forming an electrical contact with the wire core. Arcuate tabs 36 and 38 are for crimping over the wire core to form the electrical connection. If an insulated wire enters terminal 10 from the right, arcuate tab 32 is crimped over the insulated portion to secure the wire. If the wire enters from the left, arcuate tab 34 is crimped over the insulation to secure the wire. The unused tab is preferably cut off. This arrangement provides an assortment of terminal 10 configurations derived from a single stamping. Thus two opposite end terminals 10, while having differing configurations, can be formed from identical stampings.

Terminals 10 for cartridge bulbs can be fabricated from sheets of conducting metal such as copper or brass by stamping operations or other suitable means known in the art. The thickness of the sheets of metal must be such that the terminals can be easily flexed when a bending force is applied, but will return to their original shape in a resilient fashion.

Referring now to FIG. 3, there is shown a perspective view of two terminals 10 mounted in a substantially planar housing generally designated 40. The terminals 10 are positioned with the free ends of the forwardly projecting contact portions 14 facing each other, such that the rigid-wire loop ends 42 of a cartridge bulb 44, having spacing between the two loop ends within the maximum and minimum tolerances, can be inserted over the free ends of contact portions 14, without flexing the terminals 10. By pressing cartridge bulb 44 toward the housing 40, terminals 10 flex toward one another. The tabs 26 cause the bending forces to be distributed over a length of the base portion 16 rather than creating a stress concentration at the joinder of the base 16 to the shoulders 28, which would tend to fatigue the metal at that stress concentration line. Once the wire loops 42 pass over the contact tabs 24, the terminals 10 resiliently snap back, placing the wire loops 42 in tension and forming an electrical connection. Contact tabs 24 serve the additional function of preventing the wire loops 42 from slipping off terminals 10, thereby locking them into place. Forces tending to slip the wire loops 42 off the ends of the contact portions 14 tend to wedge the loops 42 between the bottom portions of the tabs 26 and the base portion 16, preventing accidental dislodging of bulb 44.

In order to disengage the loops 42 it is necessary to flex the contact portions 14 toward one another so that the loops 42 can clear the extending sections of the tabs 24. Prior art designs, while providing adequate insertion effort, can produce low, undesirable removal effort, resulting in inadvertent dislodging of the bulbs. The base portion 16 of the terminals 10, being relatively wider than the contact portion 14, provides sufficient sheet metal to make the terminals 10 resilient, and also prevents the wire loops of the bulb 44 from sliding down the contact portions onto the base portions 16 of the terminals 10. The most common sizes of rigid wire loop cartridge bulbs, such as S.A.E. T-3 and T-4¾, have loop dimensions, considering the manufacturing tolerances, such that the contact portion 14 of the terminal 10 will always fit through the loop 42 if its width is less than about 0.172 inches and the loop 42 will not slide over the base 16 if its width is greater than 0.298 inches.

The cartridge bulb 44 can be easily removed from the housing 40 by simply flexing the terminals 10 toward each other, while allowing the cartridge bulb 44 to fall away from the unit 40.

Wires 46 are used to pass electric current through the bulb 44 and are fastened by crimping to the ends of the base portions 16 of terminals 10. FIG. 3 shows wires 46 passing under housing 40 but details of the connections to the terminals 10 are not shown.

Referring now to FIGS. 4 and 5, means for supporting the terminals 10 in the housing 40 will be described. Slots 50 are provided in each end of the housing 40 for inserting terminals 10. Due to their resilient nature, terminals 10 can be inserted into the slots 50 until the base shoulders 28 contact the surfaces 52 formed on the housing 40. Tab 26 in each base portion 16 of the terminals then snaps out in a forwardly direction. Shoulders 48 in the housing 40 and tabs 26 then secure terminals 10 in place and prevent their removal from the housing 40.

The preferred embodiment of the invention as described above insures good electrical contact for cartridge type bulbs and provides a design which enables the terminals to be easily inserted and locked into a housing while enabling easy installation, positive retention to prevent accidental dislodging, and easy removal of cartridge type bulbs. Other embodiments of the invention are possible such as terminals having standard type electrical connectors placed on their base portions instead of crimp type connections. Also, many other means are possible for securing the terminals to housings such as screws or other suitable fasteners known to those skilled in the art.

We claim:

1. An assembly of a pair of resilient terminals for supporting and providing electrical contacts for a cylindrically shaped cartridge bulb of the type having rigid-wire loops disposed on each bulb end to form external filament connections, each of said terminals comprising:

an elongated member of sheet metal having a relatively side lower base portion and a narrower upper contact portion, said contact portion and said base portion being joined to form a shoulder and each terminating in a free end;

said contact portion having a downwardly depending, elongated tab, the tab being separated by a cut from said contact portion and joined thereto at one end, said tab projecting out of the plane of the contact portion, said contact portion being folded across its width between its free end and said shoulder such that the free end projects out of the plane of the contact portion in a direction opposite the elongated tab;

electrical connection forming means at the free end of said base portion; and means for supporting said base portion in a housing assembly, whereby the pair of terminals are disposed with the free ends of their respective contact portions pointing inwardly toward one another so that the rigid-wire loop ends of a cartridge bulb can easily slip over the free ends of said contact portions without bending the contact portions and further movement of the bulb away from the free ends of said contact portions flexes the terminals toward one another until said loops slip over each contact tab, locking the cartridge bulb into position.

2. The assembly as recited in claim 1, wherein the width of each of said contact portions is less than about 0.172 inches and the width of each of said base portions is greater than about 0.298 inches.

3. The assembly as recited in claim 1, wherein each of said base portions further comprises a shoulder having a width greater than the width of said base portion and a downwardly depending base tab biased to project out of the plane of said base portion, whereby said terminals can be upwardly inserted into slots formed in said housing assembly until said base tabs snap out to prevent downward movement of said terminals.

4. The assembly as recited in claim 3, wherein said housing assembly further includes a shoulder formed proximate said slot for receiving said projecting base tab of said terminal thereon and means forming a downwardly depending surface against which the base shoulders abut when the terminals are inserted into the slots.

5. The assembly as recited in claim 1, wherein said means for forming an electrical connection on the free end of each base portion further comprises a set of arcuate tabs at the free end of said base portion, whereby a wire can be inserted from either side of a terminal and secured to the base portion by crimping said arcuate tabs over the wire so that one stamping can be used for either terminal configuration.

6. The assembly as recited in claim 1, wherein said free ends of said contact portions are spaced apart a distance less than the minimum defined distance between said loops of said bulb so that said bulb slips over said free ends of said contact portion without flexing said terminals.

7. The assembly as recited in claim 1, wherein said elongated tabs are spaced apart a distance greater than the maximum defined distance between said loops of said bulb, so that movement of said loops over said elongated tabs flexes said terminals toward each other until said loops slip entirely over said tabs, thereby locking said bulbs into position.

8. A pair of resilient terminals for supporting and providing electrical contacts for a cylindrically shaped cartridge bulb of the type having wire loops disposed on each bulb end to form external filament connections, each of said terminals comprising:

an elongated member of sheet metal having a relatively wide lower base portion and a narrower upper contact portion, said contact portion and said base portion being joined to form a shoulder and each terminating in a free end;

said contact portion having a downwardly depending, elongated tab, the tab being separated by a cut from said contact portion and joined thereto at one end, said tab projecting out of the plane of the contact portion, said contact portion being folded across its width between its free end and said shoulder such that the free end projects out of the contact portion in a direction opposite the terminal tab;

electrical connection forming means at the free end of said base portion, said means comprising a set of arcuate tabs at the free end of said base portion, whereby a wire can be inserted from either side of a terminal and secured to the base portion by crimping said arcuate tabs over the wire so that the same stamping may be used for either terminal; and means for supporting said base portion in a housing assembly, whereby the pair of terminals are disposed with the free ends of their respective contact portions pointing inwardly toward one another so that the rigid-wire loop ends of a cartridge bulb can easily slip over the free ends of said contact portions without flexing the contact portions and further movement of the bulb away from the free ends of said contact portions flexes the terminals toward one another until said loops slip over each contact tab, locking the cartridge bulb into position.

* * * * *

UNITED STATES PATENT AND TRADEMARK OFFICE

CERTIFICATE OF CORRECTION

PATENT NO. : 4,938,709

DATED : July 3, 1990

INVENTOR(S) : Robert J. Smith, David J. Gardner

It is certified that error appears in the above-identified patent and that said Letters Patent is hereby corrected as shown below:

Column 3, line 60, after "wire loops" insert --42--.

Column 3, line 61, after "contact portions" insert --14--.

IN THE CLAIMS:

Claim 4, line 40, "side" should be --wide--.

Claim 5, line 4, after "said" insert --terminal--.

Signed and Sealed this

Eighteenth Day of June, 1991

*Attest:*

*Attesting Officer*

HARRY F. MANBECK, JR.

*Commissioner of Patents and Trademarks*